US009617692B2

(12) United States Patent
Brenny et al.

(10) Patent No.: US 9,617,692 B2
(45) Date of Patent: Apr. 11, 2017

(54) TIE PLUGGING MACHINE AND METHOD

(71) Applicant: Racine Railroad Products, Inc., Mt. Pleasant, WI (US)

(72) Inventors: David M. Brenny, Eagle, WI (US); Christopher M. Brenny, Burlington, WI (US)

(73) Assignee: Racine Railroad Products, Inc., Mt. Pleasant, WI (US)

( * ) Notice: Subject to any disclaimer, the term of this patent is extended or adjusted under 35 U.S.C. 154(b) by 121 days.

(21) Appl. No.: 14/510,286

(22) Filed: Oct. 9, 2014

(65) Prior Publication Data

US 2015/0101504 A1 Apr. 16, 2015

Related U.S. Application Data

(60) Provisional application No. 61/889,096, filed on Oct. 10, 2013.

(51) Int. Cl.
*E01B 31/26* (2006.01)
*E01B 31/24* (2006.01)

(52) U.S. Cl.
CPC ..... *E01B 31/24* (2013.01); *E01B 31/26* (2013.01)

(58) Field of Classification Search
CPC ..... E01B 31/26; E01B 29/32; E01B 29/26; E01B 29/24; E01B 31/24; E01B 9/14; E01B 29/28; E01B 31/20
USPC ..... 104/17.1, 17.2, 279
See application file for complete search history.

(56) References Cited

U.S. PATENT DOCUMENTS

| | | | | |
|---|---|---|---|---|
| 2,887,135 | A | 5/1959 | Fox et al. | |
| 3,114,331 | A | 12/1963 | Elliott | |
| 3,144,835 | A | 8/1964 | Pehoski et al. | |
| 3,338,184 | A | 8/1967 | Fisher | |
| 4,393,784 | A | 7/1983 | Theurer | |
| 4,566,389 | A | 1/1986 | Theurer et al. | |
| 4,921,732 | A * | 5/1990 | Bounds | B61K 3/02 104/307 |
| 5,402,547 | A * | 4/1995 | Theurer | E01B 27/026 104/279 |

(Continued)

OTHER PUBLICATIONS

Encore Rail Systems, Inc., RTP Ride on Tie Plugger, May 2008, 2 pages.

(Continued)

*Primary Examiner* — Mark Le
(74) *Attorney, Agent, or Firm* — Boyle Fredrickson, S.C.

(57) ABSTRACT

A railroad tie maintenance vehicle is configured to seal spike holes in a railroad tie formed by the removal of railroad spikes. The vehicle includes a chassis with an integrated operator work station. The vehicle may move along railroad tracks with a plurality of wheels that support the chassis and that are configured to engage at least one railroad track. A motive power source, supported on the chassis, may be controlled by an operator within the operator work station to propel the vehicle along the railroad tracks. At least one storage vessel on the chassis contains a chemical solution used to fill the spike holes. At least two injection devices on the chassis are remotely controlled by the single operator, possibly by the operation of a single controller such as a joystick, to move into alignment with respective spike holes and to fill the spike holes with the chemical solution.

20 Claims, 14 Drawing Sheets

(56) References Cited

U.S. PATENT DOCUMENTS

| | | | | |
|---|---|---|---|---|
| 5,487,341 | A * | 1/1996 | Newman | E01B 29/26 104/17.1 |
| 5,636,574 | A * | 6/1997 | Pierrot | E01B 31/26 104/17.1 |
| 6,598,537 | B2 | 7/2003 | DeLucia et al. | |
| 6,832,558 | B2 | 12/2004 | Weber et al. | |
| 8,025,013 | B2 | 9/2011 | Delucia et al. | |
| 8,075,302 | B1 * | 12/2011 | McClellan | B29B 7/325 366/159.1 |
| 2009/0145324 | A1 | 6/2009 | Delmonico | |
| 2011/0120342 | A1 * | 5/2011 | Delucia | B61D 15/00 105/238.1 |
| 2012/0215354 | A1 * | 8/2012 | Krasny | B25J 9/1666 700/255 |

OTHER PUBLICATIONS

Encore Rail Systems, Inc., TPI-PS Small Tie and Rail Projects, Apr. 2010, 1 page.
Encore Rail Systems, Inc., TPI-TG Tie and Gaging Gangs, May 2008, 2 pages.
Sperling Railway Services, Inc., Tie Plugger Carrier, 1 page.
Sperling Railway Services, Inc., Large Tie Plugger Carrier, 1 page.

* cited by examiner

TIE PLUGGING MACHINE AND METHOD

CROSS REFERENCE TO A RELATED APPLICATION

This application claims the benefit of the filing date of U.S. Provisional Patent Application Ser. No. 61/889,096, filed Oct. 10, 2013 and entitled "Tie Plate Plugging Machine," the subject matter of which is hereby incorporated by reference in its entirety.

BACKGROUND OF THE INVENTION

1. Field of the Invention

The present invention relates in general to the field of railroad maintenance. More particularly, the present invention relates to a vehicle that dispenses a chemical solution into spike holes of railroad ties during track maintenance.

2. Discussion of the Related Art

Rail anchors, used to secure a rail to railroad ties, typically are held in place by spikes driven into the ties. These spikes are removed during a variety of maintenance operations such as a rail re-lay or rail changeover operation, which results in the removal of the rail, the spikes that hold the tie plates to the ties, and tie plates associated therewith and also with the replacement of the rails. As a result of the pulling of the spikes that hold the rails to their plates, several holes remain in the tie at the location vacated by the plate. It is usually desirable to plug these "spike holes" to prevent rot and water freezing in the open spike holes from causing damage to the tie. In addition, should a spike be inserted into an existing spike hole, something of a substance should be in the location to retain the hold-down force of the spike within the tie.

The classic approach to plugging spike holes was simply to manually insert cedar plugs into the holes as part of the rail re-lay operation. These plugs initially were inserted by laborers walking along the railway. Later, machines were developed that permitted riding operators to insert plugs using hand-held tools.

More recently, several different chemical solutions have been developed that are injected into the holes and then react either with a component of the injected material, chemical, or water to form a relatively hard substance that approximates the physical characteristics of wood. Examples of such solutions include a polyurethane-based chemical, an epoxy-based chemical, and a water-based chemical. The first way of injecting these materials was to manually inject the solution into the spike holes using a caulk gun type device or "gun" that simultaneously mixes the constituent chemicals of the solution and injects the solution into the spike holes. This technique is still in use but generally is limited to relatively small-scale applications such as replacing a short section of railway.

Vehicles have been developed permitting riding operators to manually inject solution into spike holes using guns of the type historically used by walking operators but supplied with chemicals via one or more on-board tanks rather than a self-contained cartridge on the gun. The machine may be either self-propelled and move along the rails or mounted on the back of a pickup truck or the like. They typically include a single gun that is manually directed and activated by an operator. Other than being transported by a vehicle and having tanks, these types of devices are, in essence, the same as the traditional caulk gun style operation.

In all of these machines, the guns are controlled, manipulated and triggered by operator rather than being mounted on a work head and operated automatically. In addition, each of these prior machines or techniques required a dedicated operator to each gun rather than permitting a single operator to operate multiple guns.

SUMMARY AND OBJECTS OF THE INVENTION

In accordance with an aspect of the invention, a railroad tie maintenance vehicle for sealing spike holes in a railroad tie includes a chassis with an integrated operator work station. The vehicle may move along railroad tracks with a plurality of wheels that support the chassis and that are configured to engage at least one railroad track. An optional motive power source, supported on the chassis, may be controlled by an operator within the operator work station to propel the vehicle along the railroad tracks. At least one storage vessel on the chassis contains a chemical solution used to fill holes in the ties formed by the removal of railroad spikes. To dispense the chemical solution, at least two injection devices, supported on the chassis, dispense the chemical solution directly into the spike holes. The at least two injection devices are remotely controlled by the single operator, possibly at least in part by the operation of a single controller such as a joystick, to move into alignment with respective spike holes and to fill the spike holes. In one configuration, a powered actuator assembly, is operable to move the at least two injection devices relative to the chassis to align the injection devices with the spike holes. The single operator manipulates the controller(s) to control the powered actuator assembly to move the at least two injection devices relative to the chassis into alignment with the spike holes, and also to dispense the chemical solution into the spike holes.

The actuator assembly may be configured to move the injection devices vertically and laterally relative to the chassis with at least one swing arm. One or both of the injection devices may also be movable on the swing arm(s) longitudinally of the chassis.

An automated locating function may be configured to move a work head on which the powered actuator assembly is mounted forward relative to the chassis based on a measured speed of the vehicle and a known distance between adjacent railroad ties, hence reducing the stroke required under operator control.

In the event one of the rails is removed from the railroad tracks prior to the spike hole filling operation, a crawler assembly may be included that supports the vehicle. The crawler assembly may be in direct contact with the railbed including the upper surface of the railroad ties.

A debris removal device may also be included in order to remove a debris on the railroad ties that obstruct the spike hole.

A method of operating a railroad tie maintenance vehicle is also disclosed. The method includes, via action of a single operator, manually operating a controller supported on an operator chassis of a workstation on the vehicle. The controller may include one or more joysticks. The operator can simultaneously control at least two injection devices. The injection devices may move in tandem with one another and may be placed in alignment with the spike holes under manipulation of a single controller. The dispensing of a chemical solution into the spike holes may also be controlled with the single controller.

The injection devices may be mounted on a work head that can be autonomously controlled at least in part without operator input to position the injection devices at least an approximate location above the spike holes. The approximate location may be calculated based on a measured speed of the vehicle and a known distance between successive railroad ties. The final location of the injection devices directly in alignment with the spike holes may then be precisely controlled by the single operator.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
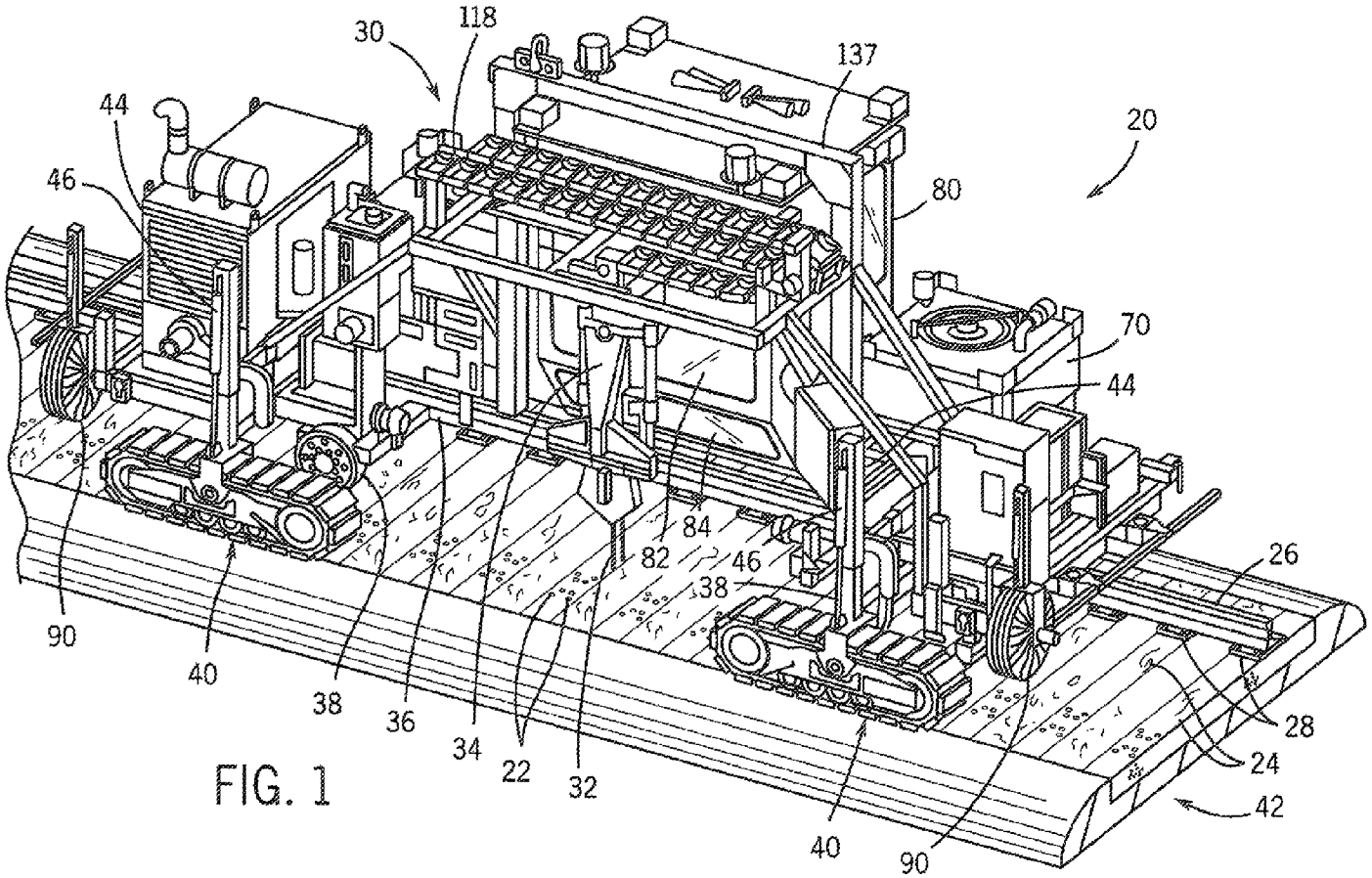
FIG. 1 is a perspective view of a tie plugging machine constructed in accordance with an embodiment of the invention, viewed from a working side of the machine.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", "supported", or terms similar thereto are often used. They are not limited to direct connection but include connection through other elements where such connection is recognized as being equivalent by those skilled in the art.

DETAILED DESCRIPTION OF EMBODIMENTS

The present invention and the various features and advantageous details thereof are explained more fully with reference to the non-limiting embodiments described in detail in the following description.

Referring to the drawings and initially to FIGS. 1-5, a tie plugging machine 20 or vehicle for plugging spike holes 22 in railroad ties 24 is illustrated. The machine 20 typically will be used as part of a track re-laying operation in which a rail 26 is removed and replaced with a new rail. As part of this process, the spikes (not shown) holding the rail 26 to the tie 24 and holding the tie plate 28 to the rail 26 are removed by one or more machines (not shown) working ahead of the tie plugging machine 20, leaving holes 22 in the ties 24. Those holes 22 should be plugged to preserve the integrity of the tie 24 and to provide solid surfaces into which new spikes (not shown) may be driven. Plugging typically involves the injection of a two-part chemical solution 94 into the holes 22, the solution 94 being formed from a two-part epoxy, polyurethane, or a water-based system.

Figure 2:
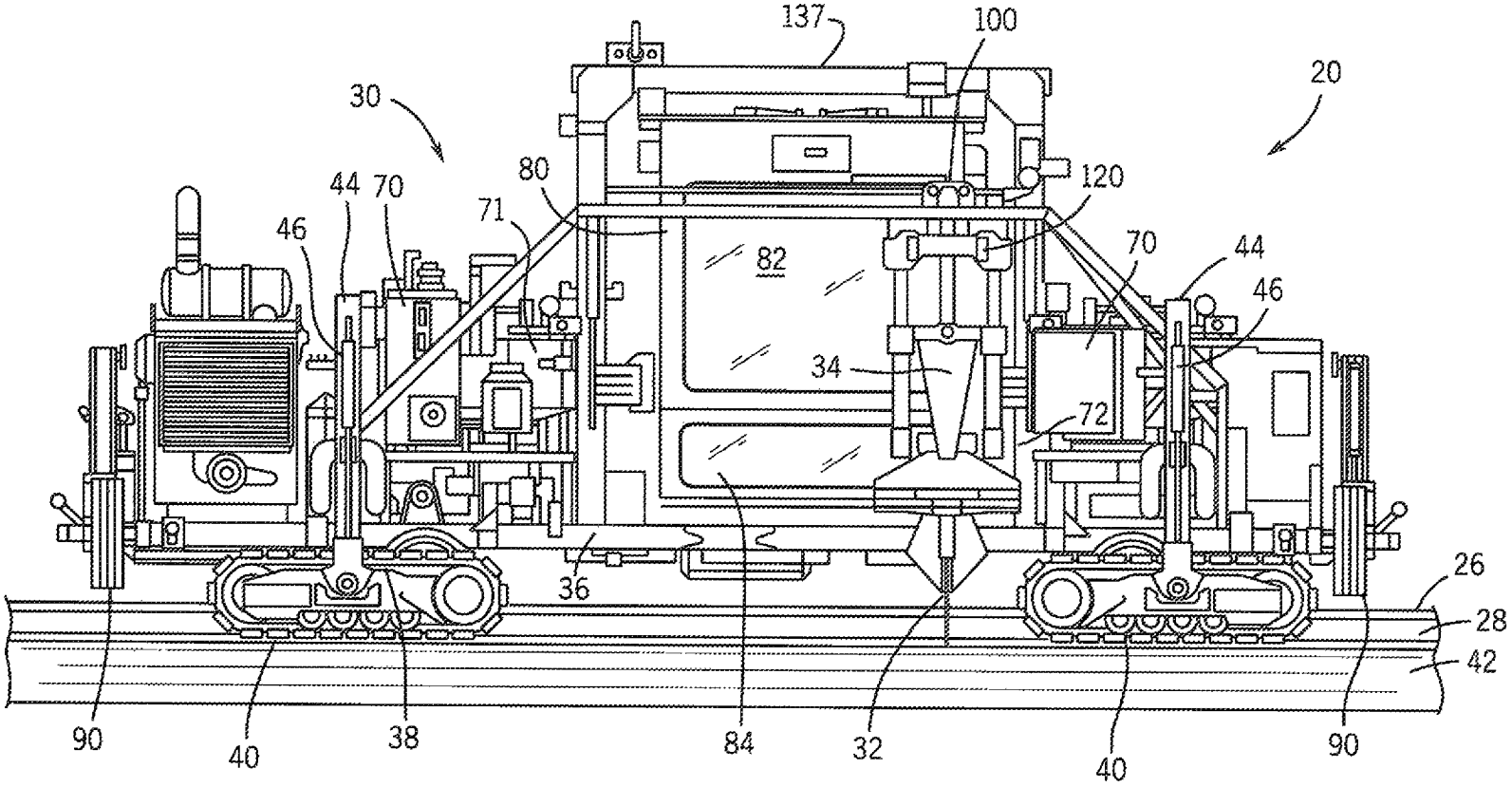
FIG. 2 is a side elevation view of a tie plugging machine constructed in accordance with an embodiment of the invention, viewed from the working side of the machine.
Figure 3:
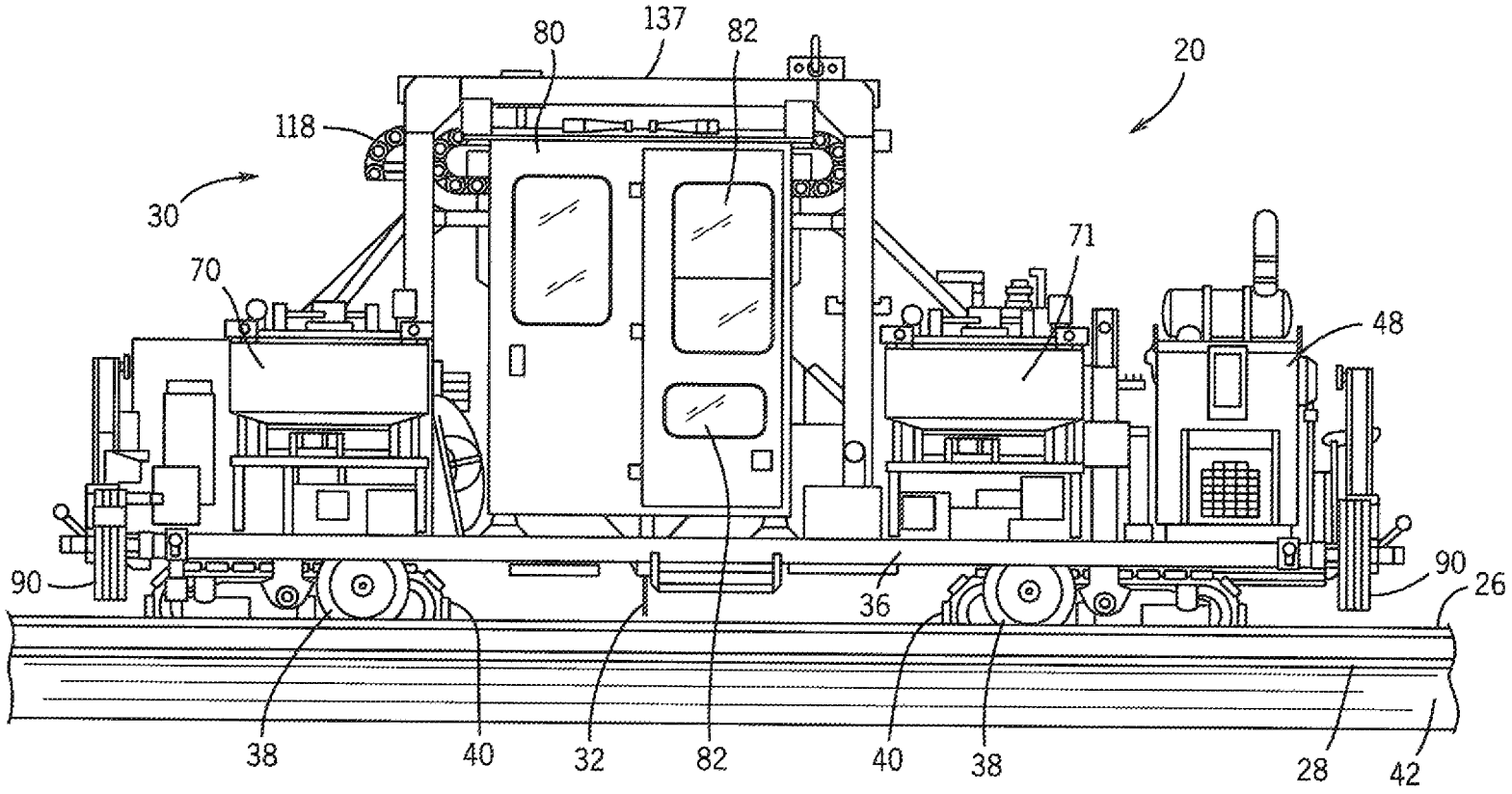
FIG. 3 is a side elevation view of a tie plugging machine of FIG. 1, viewed from the side of the machine opposite the working side.

The tie plugging machine 20 illustrated in the drawings includes a self-propelled vehicle 30 bearing injection devices 32 supported on a work head 34 that is movably mounted on a platform or chassis 36 of a the vehicle 30. Referring now to FIG. 2, the machine 20 has a "working side" on which the work head 34 is mounted. The vehicle 30 is supported on a rail 26 of the railway on at least one set of wheels 38 positioned along the side of the machine 20 opposite the working side of the machine 20. The machine 20 may also include a second set of wheels 38 on the working side of the machine 20 for rolling along an opposite rail (not shown), if that rail is present. Crawlers 40, positioned outboard of the second set of wheels 38, also are provided for supporting the machine 20 on the railbed 42, permitting propulsion along railway sections in which one rail 26 has been removed. Each crawler 40 is mounted on a mast 44 so as to be movable vertically into and out of engagement with the railbed 42 via operation of an associated hydraulic cylinder 46. The tie plugging machine 20 may also be configured with crawlers 40 on both sides of the chassis 36, allowing operation with both rails 26 removed from the track. The vehicle 30 is propelled by a motive power source 48 located, in this case, near the rear end of the machine 20. The motive power source 48 may be, for example, a gasoline or diesel engine. Alternatively, the machine 20 could be towed by another machine.

Two injection devices 32A, 32B, shown in greater detail in FIGS. 6-10, are provided on the work head 34. Referring briefly to FIG. 11, the injection devices 32 are movable vertically, as shown by arrow 60; laterally, as shown by arrow 62; and longitudinally, as shown by 64; of the chassis 36 to permit them to be positioned over the desired spike holes 22 as the machine 20 travels along the railway. One of the injection devices 32A (the "gauge side injection device" 32A) is positioned over the inboard, or gauge side, of a set of spike holes 22 and the other (the "field side injection device" 32B) is positioned over the outboard, or field set, of spike holes 22. When the machine 20 is configured for filling holes 22 of the traditional four hole pattern shown in FIG. 11, the injection devices 32A, 32B preferably are offset diagonally from one another so that, when the gauge side injection device 32A is positioned over the inboard front hole 22, the field side injection device 32B is positioned over the outboard, rear hole 22. FIG. 11 also shows a rail 26 section removed from the track.

In a preferred mode of operation, injection devices on a second work head (not shown) positioned in front of or behind the work head 34 are of the opposite configuration so as to operate in tandem with the work head 34 to fill the remaining two diagonally opposed spike holes 22. It is also possible to have a work head (not shown) on the opposite side of the chassis 36 from the working side, and have the same or another operator (not shown) control the injection devices 32 on that work head 34. Purely automated operation is also possible with sufficiently sophisticated sensors and controls.

Referring again to FIGS. 1-5, the injection devices 32A, 32B receive chemical solution from one or more storage tanks. A preferred solution is a two-part resin solution, the two components of which are stored in relative large storage tanks 70, 71 mounted on the chassis 36 in front of and behind the work head 34, respectively. Alternatively, both tanks 70 and 71 could be located at a common end of the chassis 36. Each tank 70, 71 preferably has a sufficient capacity to permit continuous operation of the vehicle 30 for an extended period of time. A minimum per-tank capacity of 50 gallons, and preferably of at least 100 gallons, is presently preferred. The chemicals are transferred from the tanks 70, 71 to the injection devices 32A, 32B through hoses 72 under control of the operator and are mixed to form the solution while they are flowing through hollow mixing nozzles 74 at the bottoms of the injection devices 32A, 32B.

Still referring to FIGS. 1-5, the machine 20 is controlled by an operator located in an operator work station 80 located generally centrally of the chassis 36 adjacent the working side of the machine 20 next to the work head 34. The operator work station 80 preferably takes the form of an environmentally controlled enclosed cab that shields a seated operator within from the elements as well as the chemicals dispensed by the injection devices 32A, 32B. Windows 82 may be provided on various sides of the operator work station 80 to allow the operator to direct the tie plugging machine's 20 movement. An additional window 84 may be provided towards the floor of the operator work station 80 that is angled towards the injection devices 32. This window 84 provides a clear, unobstructed view of the spike holes 22 and the injection devices 32.

Figure 4:
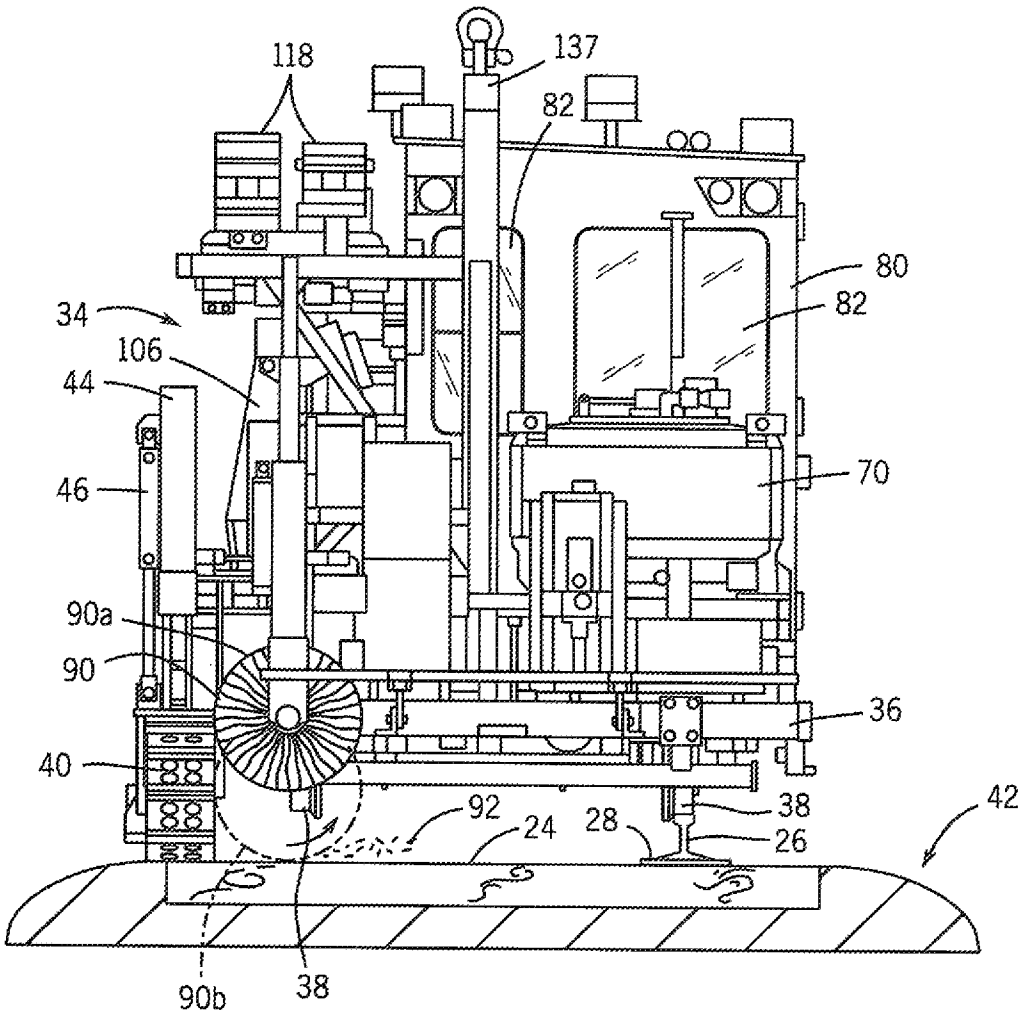
FIG. 4 is front end elevation view of a tie plugging machine of FIGS. 1-3.
Figure 5:
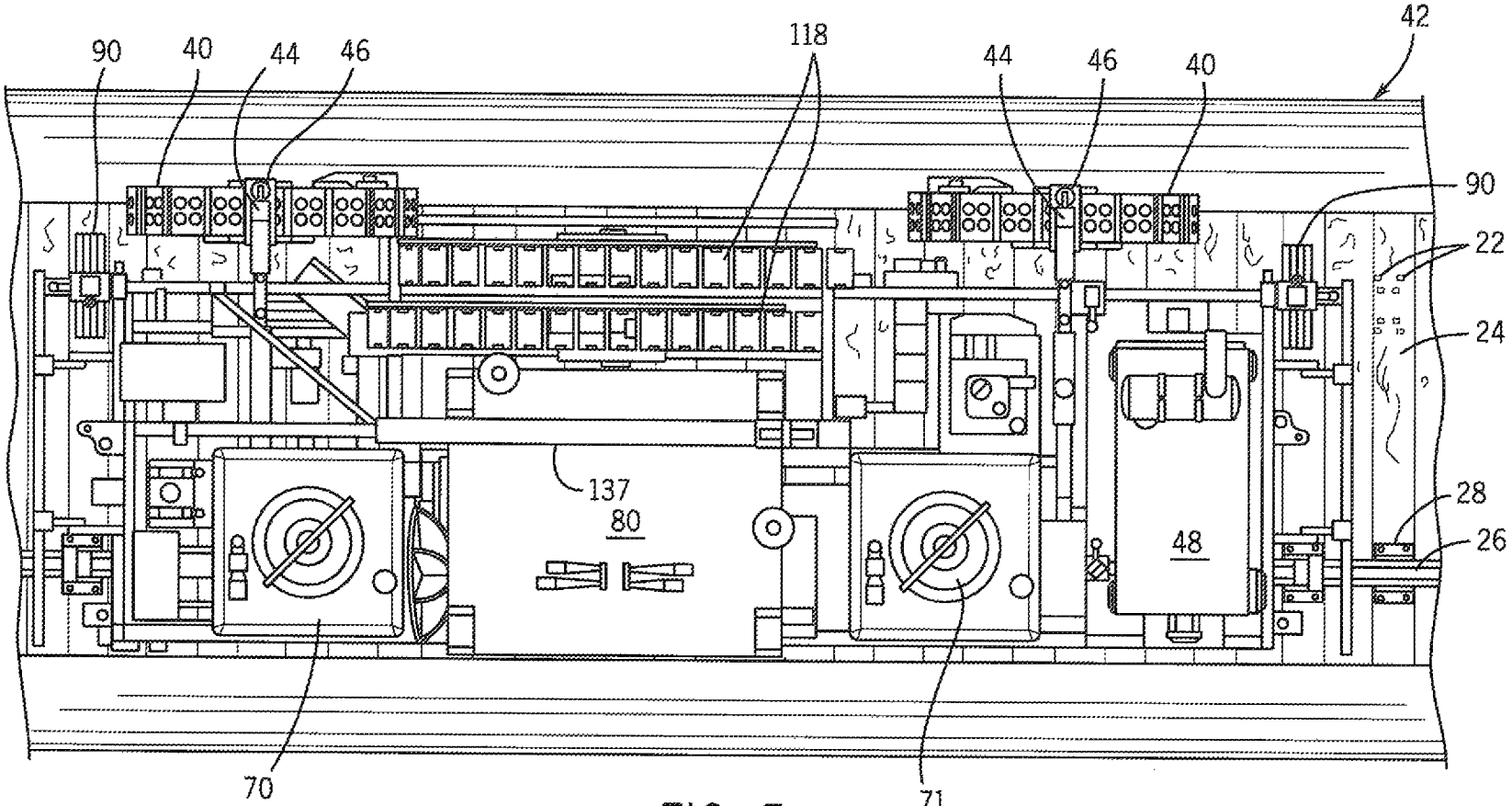
FIG. 5 is top plan view of a tie plugging machine of FIGS. 1-4.

Referring specifically to FIGS. 2 and 4, brushes 90 are located at the front and rear ends of the tie plugging machine 20 and may be extended to contact the ties 24, and retracted away from the ties 24, in order to sweep aside any debris 92 on the surface of the ties 24. This allows for unobstructed access to the spike holes 22 for injection of the chemical compound. Referring to FIG. 4, the brush 90 is shown in this view in the retracted position 90*a* in solid lines and in the deployed position 90*b* in phantom lines. Each brush 90 is driven by an electric or hydraulic motor (not shown) as the tie plugging machine 20 moves along the rail 26. The brush rotation sweeps debris 92 away from the spike holes 22, which could otherwise prevent injection of the chemical solution 94 into the spike holes 22. Each brush 90 may also include an abrasive filament (not shown) designed to strip away damaged wood from the tie 24.

Referring again to FIG. 6-10, the work head 34 is mounted on the chassis 36 so as to be movable longitudinally, as shown by arrow 64, relative to the chassis 36, hence permitting coarse positioning of the injection devices 32 relative to the chassis 36 as the machine 20 travels along the railway as discussed in greater detail below. The movement is effected by a powered actuator assembly formed from several cylinders and motors. The field 32B and gauge side 32A injection devices are mounted on the work head 34, and the work head 34 is mounted on the chassis 36, so as to permit the injection devices 32A and 32B to be movable at least longitudinally and laterally relative to the chassis 36 and preferably vertically as well. The injection devices 32A and 32B preferably are movable about the work head 34 vertically, as shown by arrow 60; laterally, as shown by arrow 62; and longitudinally, as shown by arrow 64; relative to the chassis 36 so as to permit precise alignment of the injection devices 32 relative to the spike holes 22 as seen in FIG. 11. This alignment, in combination with controlled injection on demand, dramatically reduces the amount of wasted hole filling solution 94, reducing both costs and environmental impact. In addition, in order to reduce operator effort, the mixing tips 96 of the injection devices 32 preferably may be positioned and locked in place to have a specific offset with respect to one another in order to accommodate a specific standard spike hole 22 pattern such as the one illustrated in FIG. 11. Locking the offset of the mixing tips 96 in position allows the operator to move both injection devices 32A, 32B in tandem with one another at all times. Hence, once one mixing tip 96 of the injection device 32A is positioned directly above a spike hole 22, the mixing tip 96 of the other injecting device 32B will likewise be in proper position over a diagonally opposed spike hole 22.

The degrees of freedom desired to move the injection devices 32A, 32B could be accommodated using any of a variety of techniques, one of which will now be detailed. Specifically, the work head 34 of this embodiment includes a carriage 100, front and rear vertical support rods 102 extending downwardly from the carriage 100, and a swing arm support frame 104 that is movable vertically along the vertical support rods 102. First and second (gauge and field) laterally spaced swing arms 106 are each mounted on the swing arm support frame 104 so as to be swingable about a respective longitudinally extending horizontal axis 136. An injection device 32A, 32B is mounted on the lower end of each swing arm 106 so as to be moveable relative to the swing arm 106 longitudinally of the machine 20.

Figure 6:
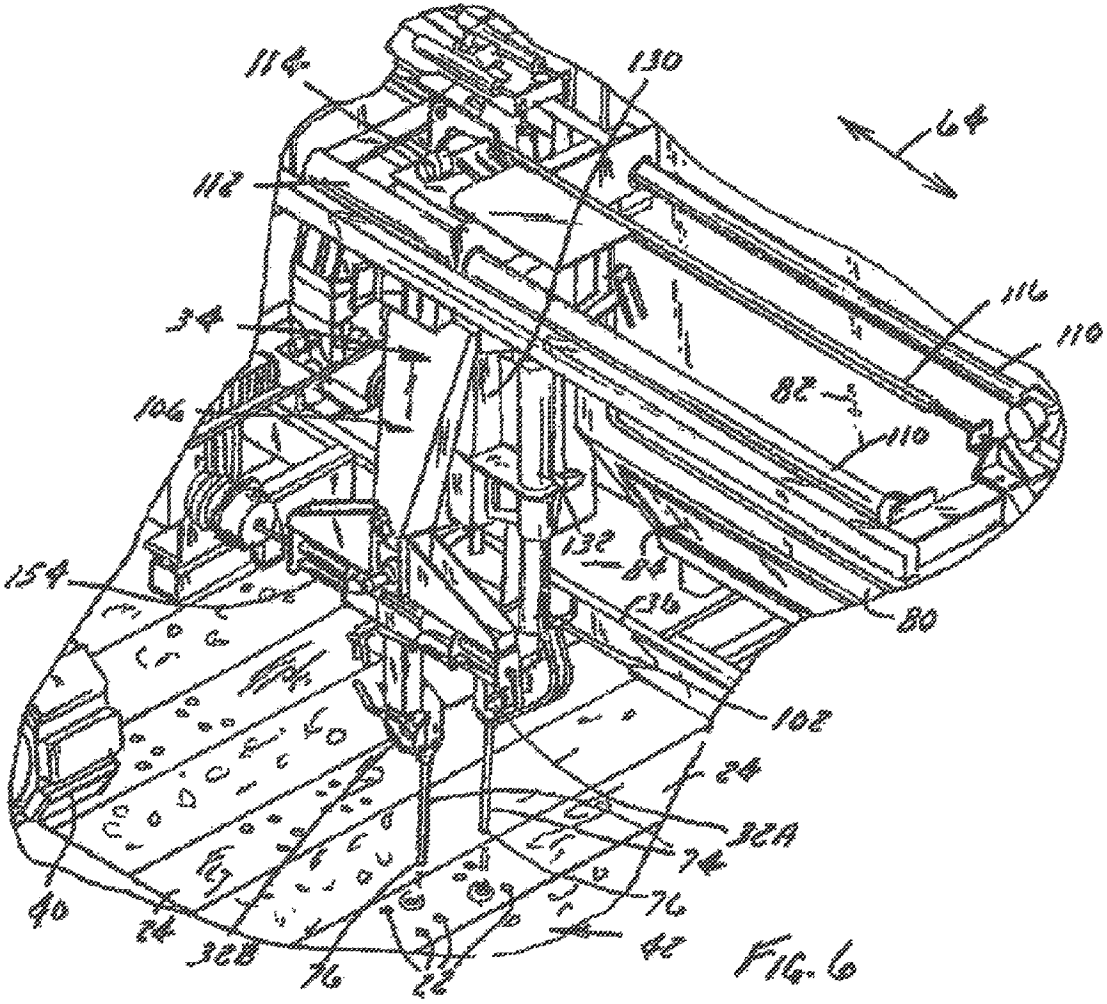
FIG. 6 is a detail view of the tie plugging machine of FIGS. 1-5, viewed from the working side of the machine and showing the work head in a first position along a guide rail.
Figure 7:
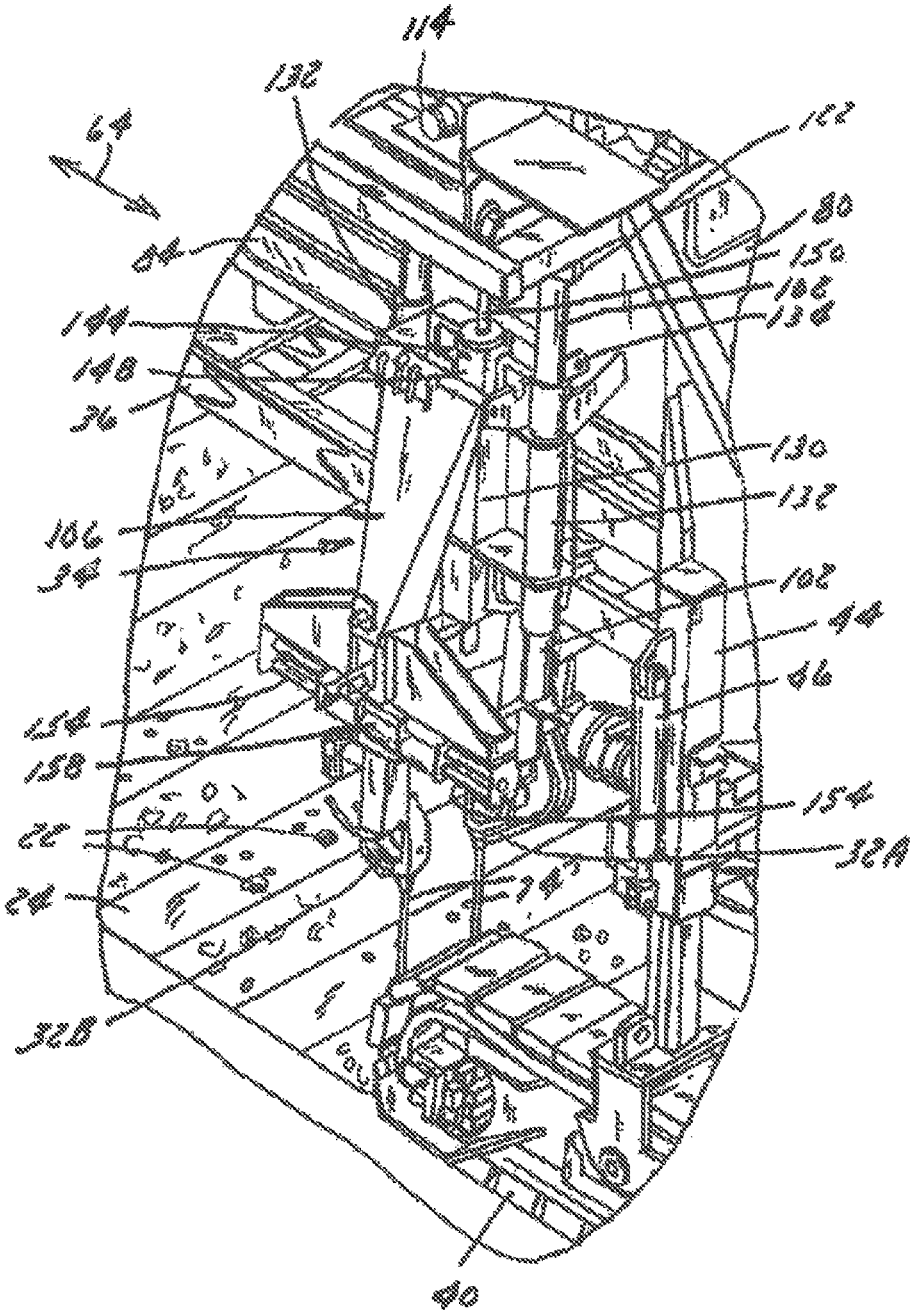
FIG. 7 is a detail view of the tie plugging machine corresponding to FIG. 5, viewed from the working side of the machine and showing the work head in a second position along the guide rail.

As best seen in FIGS. 6 and 7, the carriage 100 is mounted on an upper frame 137 of the chassis 36 by first and second laterally spaced, longitudinally extending guide rail 110, each of which supports an associated sleeve 112 of the carriage 100. The carriage 100 can be driven to move longitudinally along the guide rail 110 by an electric motor 114 of the powered actuator assembly coupled to a rack and pinion assembly 116 from a rearmost position illustrated in FIG. 6 to a forward-most position illustrated in FIG. 7. This work head movement allows the tie plugging machine 20 to maintain a steady speed of travel along the rail 26 while maintaining the work head 34 over a given set of spike holes 22 for a period of time that permits the operator to finely position the pre-positioned injection devices 32A, 32B into alignment with the spike holes 22 and to inject the solution into the spike holes 22. It also permits the work head 34 to "catch up" or shuttle into the vicinity of the next down-track tie 24 upon completion of a spike hole plugging operation on a given tie 24. This movement may be partially or even wholly automated under control of an on-board computer (not shown) to reduce the need for operator input. Movement of hydraulic and electric controls that move with the carriage 100 is accommodated by a cable tray 118 located above the carriage 100.

Figure 8A:
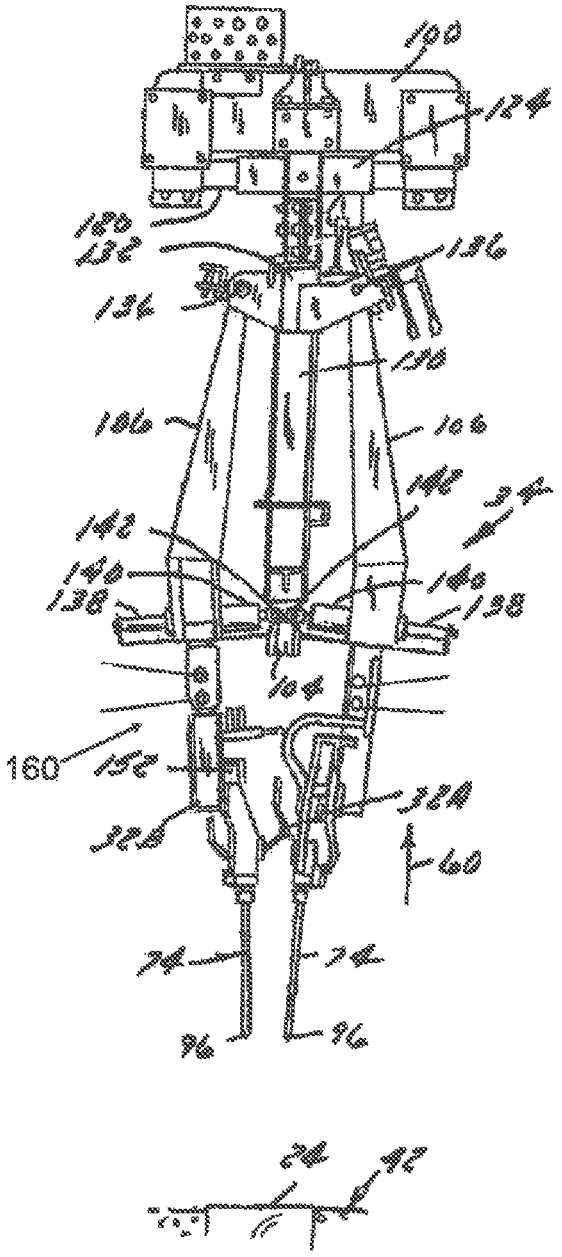
FIG. 8*a* is a side view of the work head of the tie plugging machine of FIGS. 1-7, showing a swing arm support frame in a retracted position thereof.
Figure 8B:
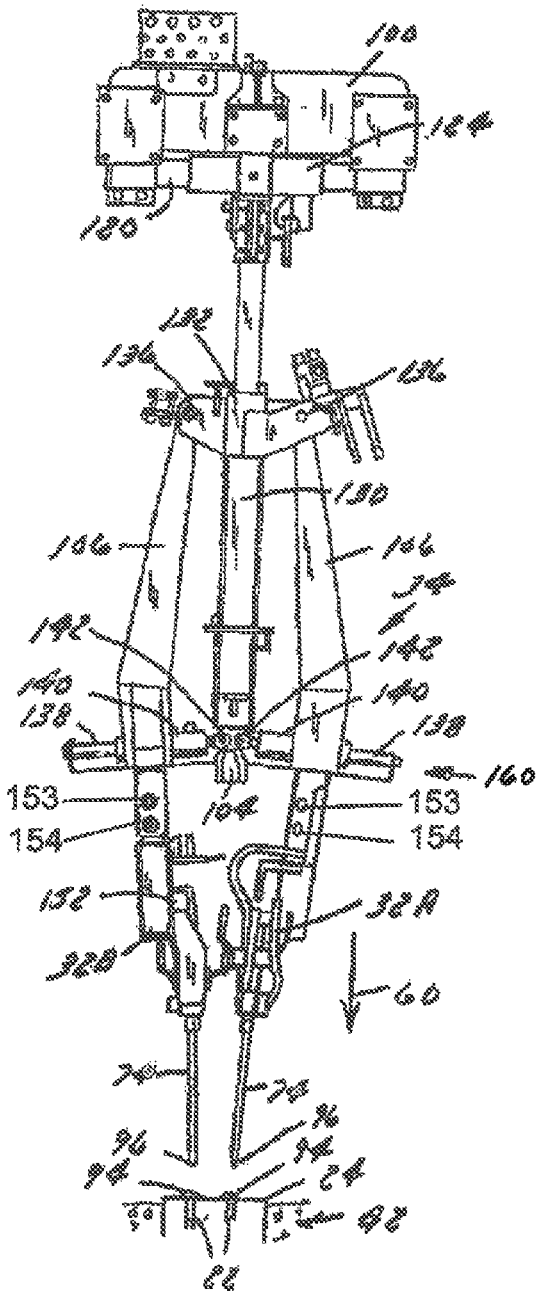
FIG. 8*b* is a side view of the work head of the tie plugging machine of FIGS. 1-7, showing the swing arm support frame in an extended position thereof.
Figure 9:
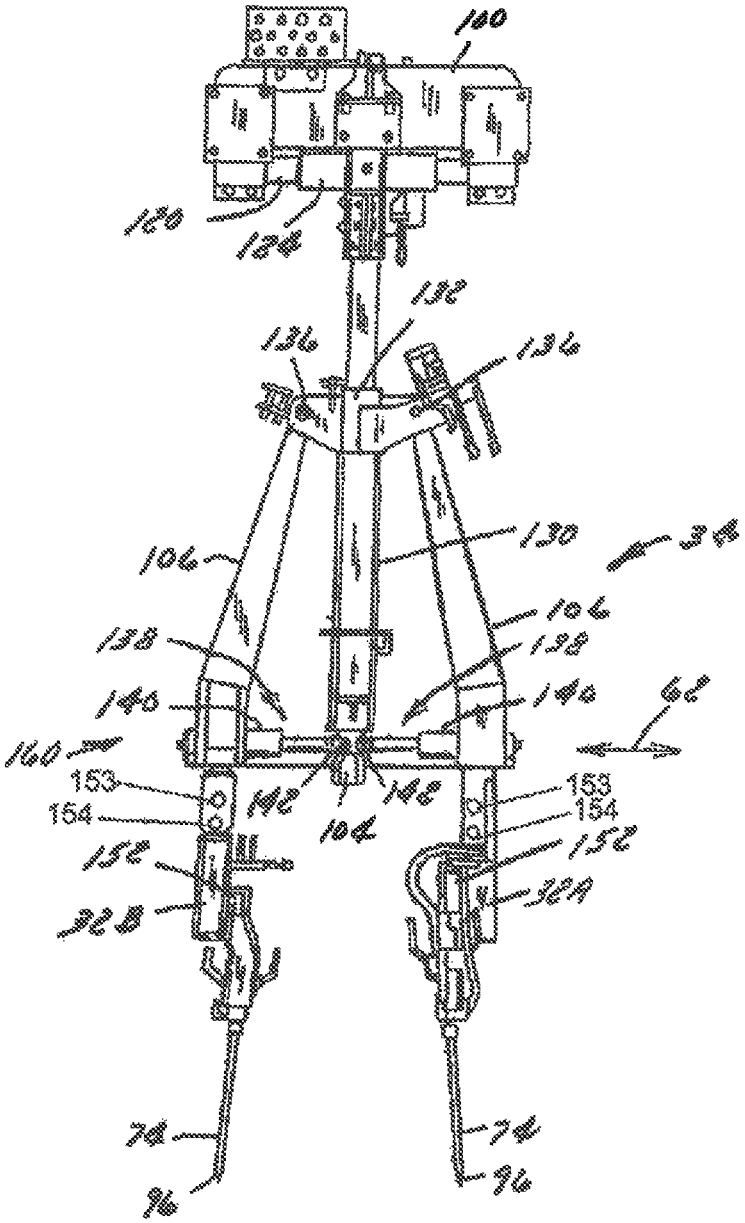
FIG. 9 is a front end elevation view of the work head of the tie plugging machine of FIGS. 1-7, showing the swing arms that support the injection devices in extended positions thereof.

Referring to FIGS. 6-9, the vertical support rods 102 are mounted on the carriage 100 by being suspended from front and rear horizontal support rods 120. Specifically, the upper end of each vertical support rod 102 is mounted on an associated end of a cross-beam 122 (FIG. 7). The cross beam 122 has front and rear ends coupled to respective sleeves 124 (the front of which is best seen in FIGS. 8A-9), each of which rides along a respective horizontal support rod 120. The cross beam 122 can be driven to move laterally by a hydraulic cylinder of the powered actuator assembly (not shown), permitting lateral centering of the swing arm support frame 104 over the spike hole pattern. This movement accommodates, amongst other things, changes in rail gauge.

Referring now to FIGS. 7-10, the swing arm support frame 104 on which the field and gauge side swing arms 106 are mounted includes a central support 130 extending between and fixed to front and rear vertical sleeve assemblies 132. Each vertical sleeve assembly 132 is slideably supported on a respective vertical support rod 102. The upper end of each swing arm 106 has front and rear ends pivotally attached to a respective ear mount 134 supported on the corresponding sleeve assembly 132. This pivotal mounting permits swinging of the swing arm 106 about the above-described horizontal axis 136 and permits lateral alignment of the injection devices 32A, 32B over the spike holes 22. As best seen in FIG. 9, each swing arm 106 is driven to pivot about its respective axis 136 by a side actuator 138 in the form of a hydraulic cylinder of the powered actuator assembly. Each hydraulic cylinder has a first, barrel end 140 coupled to the respective swing arm and a second, rod end 142 coupled to a respective side of the swing arm support frame 104. As best seen in FIG. 7, the swing arm support frame 104 can be driven to move vertically along the vertical support rods 102 via operation of an operator-controlled central actuator 144 of the powered actuator assembly located between the vertical support rods 102. The range of movement can be appreciated by comparing FIGS. 8A and 8B. In this embodiment, the actuator 144 comprises a vertically extending hydraulic cylinder having a lower, barrel end 148 attached to an upper surface of the swing arm support frame 104 and an upper, rod end 150 attached to the horizontal cross beam 122. This movement not only can be used for fine positioning of the injection devices 32A, 32B during a spike hole plugging operation, but can also be used for coarse positioning to move the injection devices between stowed and deployed positions and/or to accommodate mixing nozzles 74 of different lengths. The range of injection device positions can be additionally extended by introducing the capability of bolting the injection devices 32A, 32B at different heights on the upper supports 152.

Figure 10:
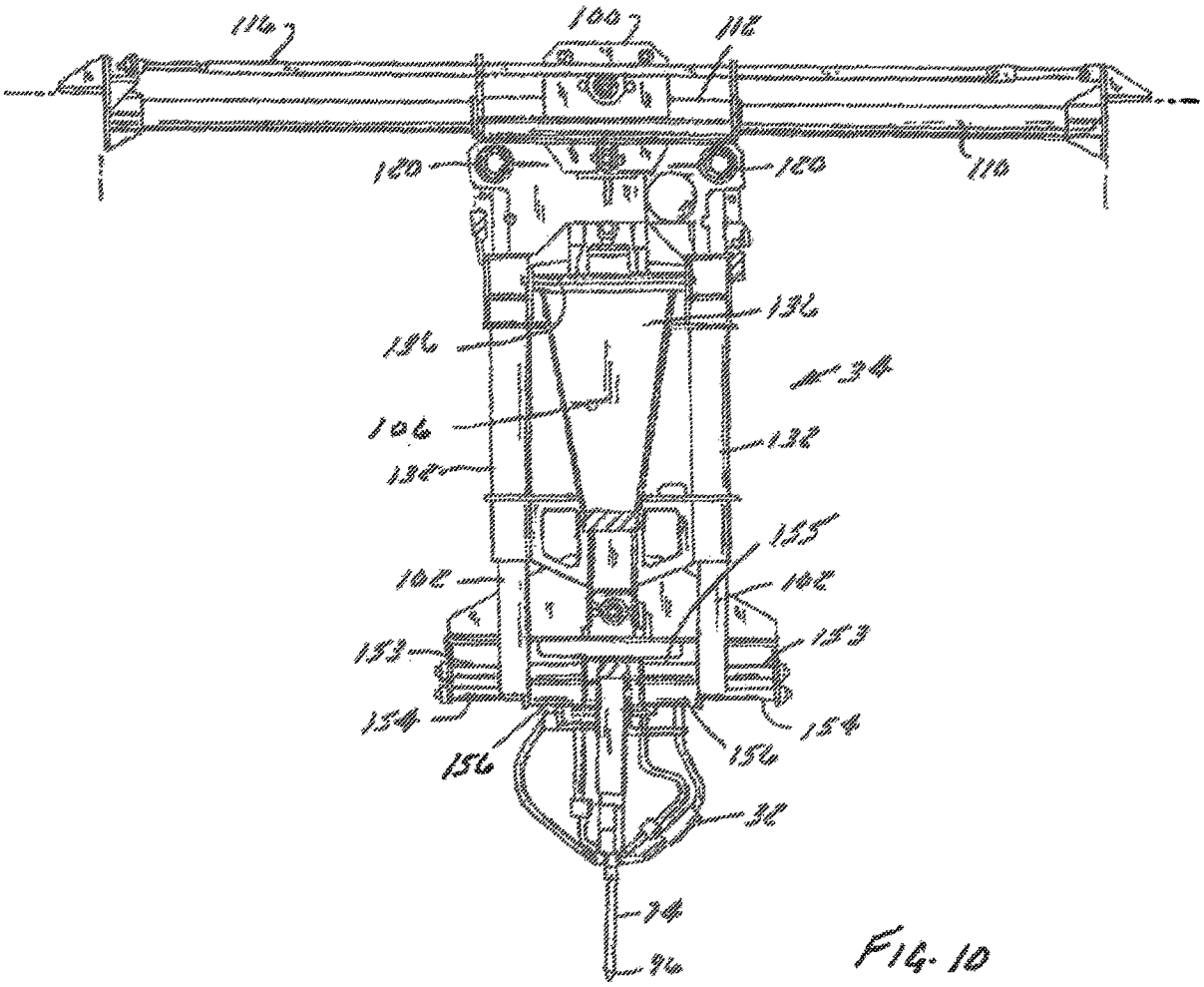
FIG. 10 is a front end sectional elevation view, taken through the center of the work head of the tie plugging machine of FIGS. 1-7.
Figure 11:
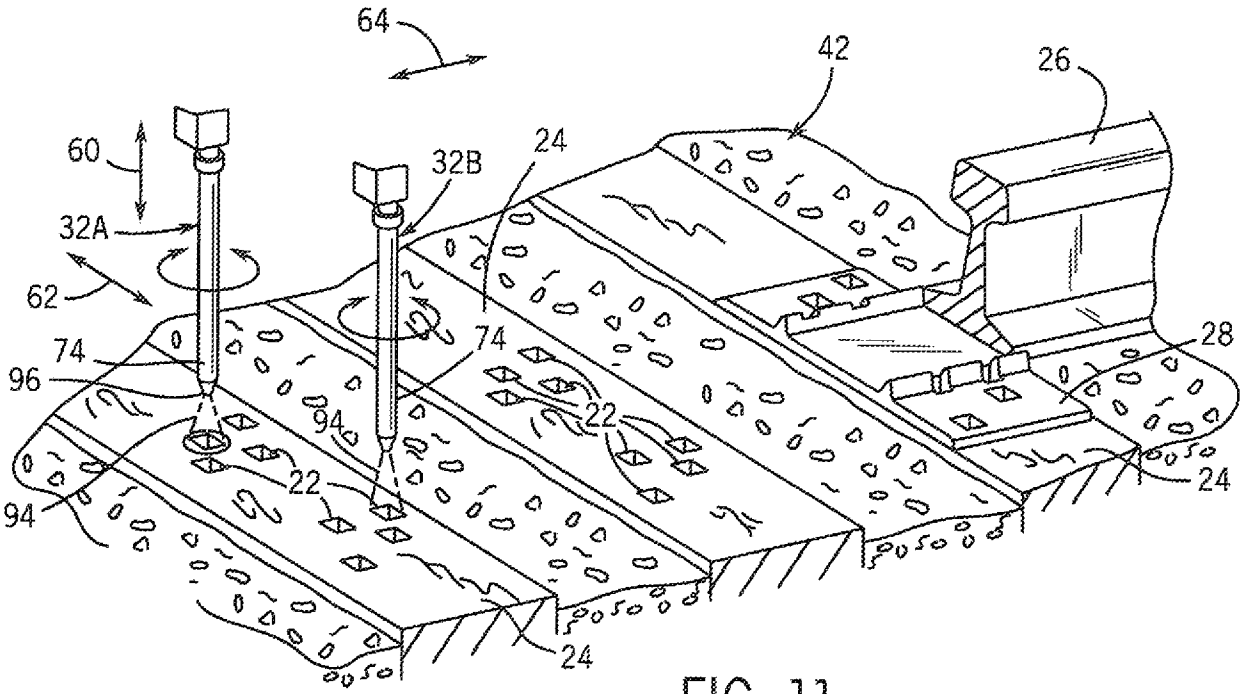
FIG. 11 is a representation of a rail tie and rail section incorporating a hole pattern pluggable using the tie plugging machine of FIGS. 1-7.

Referring to FIGS. 6-11, each injection device 32A, 32B comprises a lower mixing tip 96 (as described above) extending downwardly from an upper support 152. The upper support of at least one of the injection devices is mounted on the associated swing arm 106 so as to be moveable along the swing arm 106 longitudinally of the machine 20 to permit fine positioning of the injection devices 32A and 32B relative to the work head 34 when the work head 34 has been positioned in the vicinity of the spike holes 22 by movement of the machine 20 along the railway and movement of the work head 34 along the machine 20. In the illustrated embodiment, this movement is accommodated by upper and lower guide longitudinally extending rods, 153 and 154 respectively, that support corresponding guide sleeves, 155 and 156 respectively, which form an integral unit with the upper support 152 as best seen in FIG. 10. The upper support 152 can be driven to move along the guide rods 153 and 154 by a hydraulic cylinder (not shown) controlled by the operator to position the hollow mixing nozzles 74 in the general vicinity of the spike holes 22. In the illustrated embodiment, only one of the injection devices, such as the field side injection device 32B, may be imbued with the capability of longitudinal movement relative to the rails and thus need be fitted with rods 153 and 154 and the associated cylinder and related controls. Alternatively, and as illustrated, both of the field and gauge sides' injection devices 32B and 32A may be capable of being driven to move longitudinally of the rail.

The positions of the various moving components of the machine 20 may be monitored by any combination of various electrical sensors, optical sensors, limit switches, etc. (not shown). In a particularly simple embodiment each of the cylinders takes the form of a so-called "smart cylinder" having an internal sensor that monitors the stroke of the cylinder and, thus, the position of the driven component.

The position of the side actuators 138, as well as the extension or retraction of the work head 34, may be set prior to operation to the known spacing of the spike holes 22. Alternatively, the machine's 20 on-board computer may dynamically control the side actuators 138, as well as the entire actuator assembly 160, to control the positioning of the injection devices 32A and 32B in both the vertical and horizontal planes during operation to locate the mixing nozzles 74 in the proper position above each spike hole 22. This operation may also be performed while the tie plugging machine 20 is moving along the railbed 42. The operator within the operator work station 80 may manually control movement of the work head 34 during operation. Transitioning to FIG. 10, the work head 34 is shown in the retracted position and supported by the guide rail 110.

Figure 12:
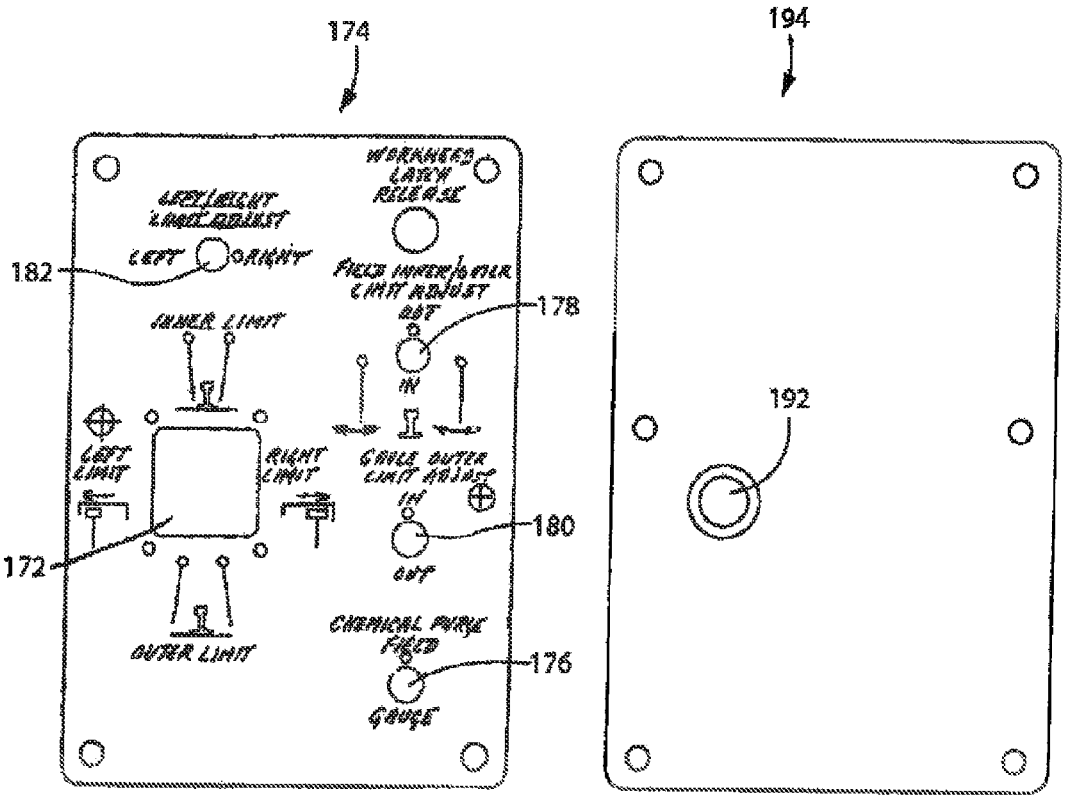
FIG. 12 is a schematic top plan view of a pair of control panels for the work head.

As mentioned above, all of the above-described aspects of the machine 20 can be controlled by a single operator stationed in the workstation 80. Preferably, the injection devices 32 are positioned and operated by a single controller located within control panel 174 positioned adjacent one side, such as the left side, of the operator's seat. One such controller is shown in FIG. 12 notably including a dual-axis joystick 172 shown in more detail in FIG. 13. In addition to supporting the joystick 172, the control panel 174 may have various controls such as a switch 176 for "purging" the injection devices with a cleaning solution, field and gauge side switches 178 and 180 for moving the field and gauge side dispensing devices 32B and 32A to their stowed positions, etc. and/or for setting the limits the lateral movement of the field and gauge side swing arms. Another limit switch 182 can be used to adjust the limit of movement of the field side injection device 32B longitudinally of the rail or left/right relative to the workhead. The control panel 174 thus allows the operator to not only manipulate the work head's motion and dispensing of chemical solution 94, but also allows the operator to set the operating parameters of the work head 34. The operating parameters thus include the inner and outer limits of the work head's 34 vertical motion, described above with respect to FIGS. 8*a*, 8*b*, and 9, and the left and right limits of the work head's 34 lateral motion, described above with respect to FIGS. 6 and 7.

Figure 13:
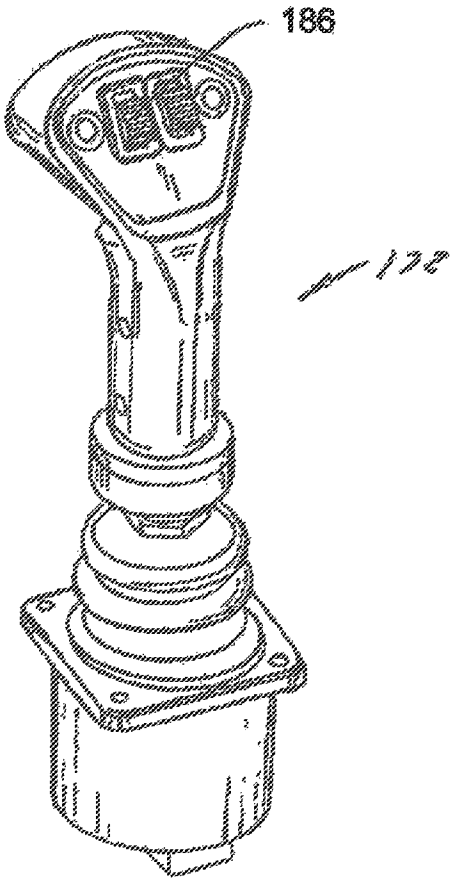
FIG. 13 is an isometric view of a joystick of the control panel shown in FIG. 12.

The joystick 172 is best seen in FIG. 13. Movement of the joystick 172 along a first axis, such as side-to-side, actuates the side actuators 138 to pivot the swing arms 106 laterally of the rails about the axis 136. Actuation of the joystick 172 along the second axis, such as fore-and-aft, actuates at least one cylinder to move the corresponding injection device fore and aft on the guide rods 153 and 154 relative to the swing arms 106. As discussed above, in the illustrated embodiment, it is possible that only one such injection device, such as the field side injection device 32B may have the capability to move longitudinally of the rail under the control of joystick 172.

Field and gauge side dispensing buttons 186 may also be provided on the joystick 172, allowing the operator to control injection of chemical solution dispensed from the associated field and gauge side injection devices 32B, 32A as well as the duration of each injection event. For example, the operator may hold a dispensing button 186 down for a sufficient period of time for the injection devices 32A and 32B to continuously dispense enough chemical solution 94 to fill the allocated spike holes 22. Alternatively, simply toggling a switch could dispense a designated volume of solution.

Referring again to FIG. 12, a second joystick 192 may be provided on a control panel 194 positioned beside of the operator's seat opposite workstation opposite the control panel 174. Joystick 192 also can be a dual axis joystick and can be used to control movement of carriage 100 relative to the chassis 36. For example, lateral or side-to-side movement of the joystick 192 may be used to drive the cross beam 122 and thus the carriage 100 to move laterally of the rail to center the swing arm support the frame 104 over the spike hole pattern to accommodate, e.g., changes in rail gauge. Fore-and-aft movement of the joystick 192 can actuate the electric motor 114 to drive the workhead 34 and thus the carriage 100 to move longitudinally relative to the rail.

In operation, the tie plugging machine 20 is driven along the railway continuously at a speed of, for example, approximately 2-5 mph. When the injection operation is complete in a given tie 24, the carriage 100 automatically shuttles forward along the guide rods 110 to the next tie 24 under control of the machine's computer. The speed and extent of this movement is determined based on the prevailing speed of the machine 20 and the spacing between adjacent ties 24, which may be measured using appropriate detectors (not shown) or simply pre-set for a given standard railway configuration. This "auto-advance" feature locates the injection devices 32 approximately above the spike holes 22. The operator thereafter only needs to manipulate the joystick 172 to finely position the injection devices 32 so that mixing nozzles 74 are directly above or otherwise aligned with the spike holes 22. See FIG. 11. Specifically, when the work head 34 is positioned generally over the spike holes 22 under operation of the computer, the operator moves the second joystick 192 to generally center the carriage 100 over the spike hole pattern. He then moves the first joystick 172 fore and aft to drive at least one of the injection devices 32A, 32B longitudinally along the guide rods 153 and 154 on the swing arms 106 to align the two opposed mixing nozzles 74 of the injection devices 32 longitudinally with a given set of spike holes 22, such as the gauge and field side spike holes 22. The operator may also move the joystick 172 left or right to control the cylinders 146 to pivot the swing arms 106 to position the injection devices 32 laterally over the associated spike holes 22. The operator may then push the dispensing buttons 176 on the joystick 172 to dispense the chemical solution 94 into the spike holes 22 in a preset amount and/or in an amount controlled by the period of button actuation.

In the process described above, the use left or right limits allows the operator to adjust the workhead position to account for staggered hole patterns in the tie. So, during normal operation, the operator uses the inner and outer limits with the left and right limits selected via the first joystick 172 in conjunction with moving the workhead left and right using the second joystick 192 to effectively fill all the spike holes 22 in the tie 24.

Figure 14:
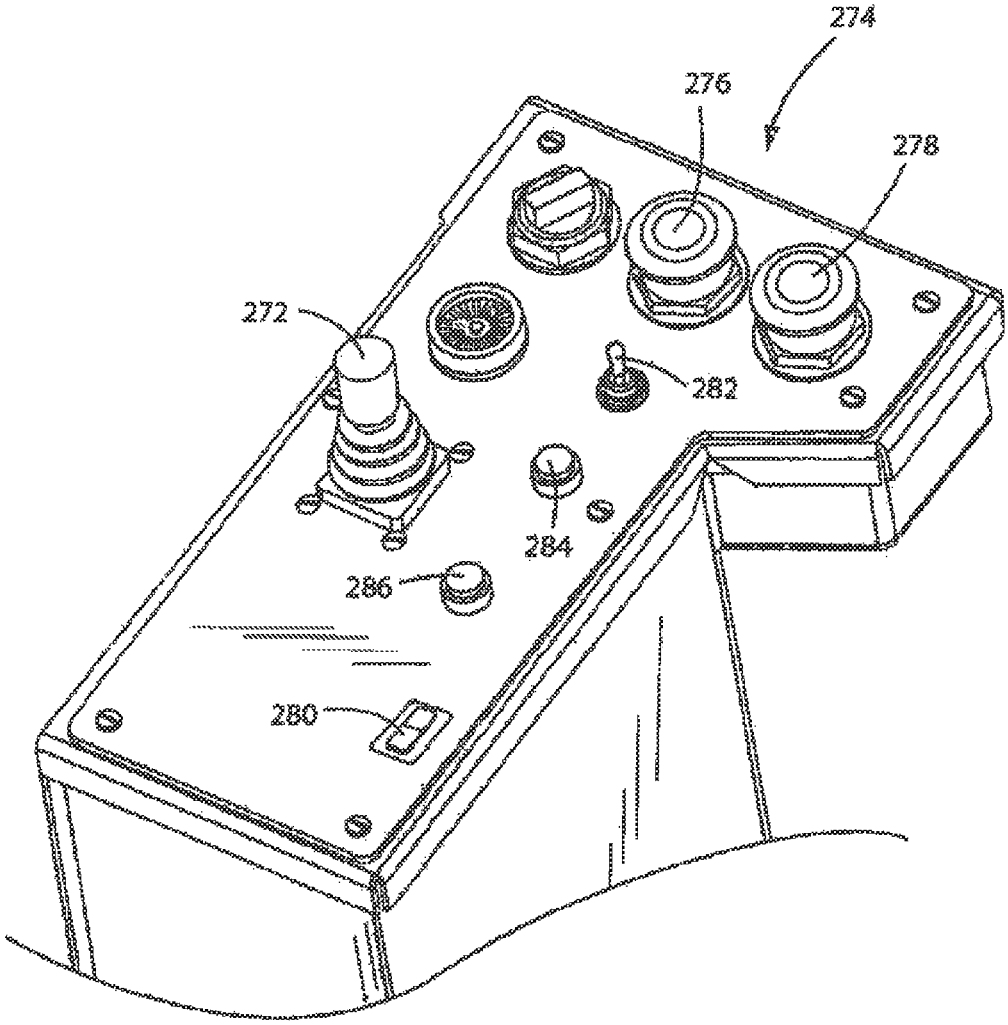
FIG. 14 is a perspective view of an alternative control panel for the work head.

Alternatively, both injection devices 32A and 32B may be provided with the capability of being driven longitudinally of the rail. This extra degree of freedom allows the workhead 34 to do more of the operator's work. A first or left hand control system having this capability is shown in FIG. 14. The system includes a single controller located within control panel 274 that notably includes a dual-axis joystick 272. Control panel 272 additionally includes start and stop buttons 276 and 278 for enabling and disabling operation of the spike hole plugger and a toggle switch 280 that enables or disables operation of components on the workhead 34. The above-described chemical purge of the injection devices can be controlled by a switch 282, which may take the form of a toggle switch permitting toggling between the gauge and field side injection devices 32A and 32B. In addition, switches 284 and 286 can be provided that allow the operator to set the field and gauge side spike hole pattern. Movement of the joystick 272 along a first axis, such as side-to-side, actuates the side actuators 138 to pivot the swing arms 106 laterally of the rails about the axis 136. Movement of the joystick 172 along the second axis, such as fore-and-aft, actuates the cylinders to move the injection devices fore and aft on the guide rods 153 and 154 relative to the swing arms 106.

During set-up, the operator can use the joystick 272 to independently control movement of each dispensing mechanisms 32A and 32B longitudinally and laterally of the railway. The operator selects either the field side or gauge side to adjust via the respective pushbutton 284 or 286 on the panel 274. Once pattern programming is complete, the joystick 272 can be to select one of up to four preset patterns. For example, Up=pattern 1; Down=pattern 2, Left=pattern 3 and right=pattern 4.

In this embodiment, the operator will use the second joystick 192 (FIG. 12) to position the workhead 34 laterally over the spike hole operation. After manipulating the joystick 172 to locate the first spike hole in the pattern, the operator can select between 4 or more different patterns on the fly by selecting them using the joystick 272 as described above. The machine is now capable of filling all of the holes in the selected without requiring the operator to reposition the workhead after the first hole is located. The operator thus only need up one hole in the pattern and pull a trigger (not shown) on the joystick 272 to fill the first spike hole in the pattern. The machine will then automatically move onto the next hole in the pattern, and then the next, until all holes in the pattern are filled. This procedure happens simultaneously on both sides of the vacated rail using both injection devices 32A and 32B. Once all the holes in the pattern are filled, the operator uses the joystick 192 (FIG. 12) to move the workhead over the next tie, lines up with the first spike hole using the joystick 272, then repeats the fill process by simply pulling the trigger on the joystick 272. The workhead then completes the hole filling by remembering the programmed hole positions.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A railroad tie maintenance vehicle for dispensing a chemical into spike holes in a railroad tie, comprising:

a chassis having an area defining an operator work station;

a plurality of wheels that support the chassis and that are configured to engage at least one railroad track;

a storage vessel secured on the chassis and containing a chemical solution;

at least two injection devices located on the chassis and configured to dispense the chemical solution into the spike holes;

a powered actuator assembly that is operable to move the at least two injection devices relative to the chassis;

at least one controller in the operator work station and operable by a single operator within the work station to control the powered actuator assembly to move the at least two injection devices relative to the chassis and relative to each other to a location in alignment with the spike holes and to dispense the chemical solution into the spike holes.

2. The railroad tie maintenance vehicle of claim 1, further comprising:

a work head supporting the injection devices, the work head being supported on and movable longitudinally relative to the chassis.

3. The railroad tie maintenance vehicle of claim 2, further comprising controls that drive the work head to move relative to the chassis to position the injection devices at a location proximate to the spike holes without operator input.

4. The railroad tie maintenance vehicle of claim 3, wherein the actuator assembly is configured to move the injection devices vertically, laterally, and longitudinally relative to the work head.

5. The railroad tie maintenance vehicle of claim 2, further comprising:

a swing arm supported on the work head and configured to be driven by the actuator assembly to move one of the injection devices in a swinging motion laterally and vertically relative to the work head and relative to the other injection device.

6. The railroad tie maintenance vehicle of claim 1, wherein the at least one controller includes a joystick manually operable by the single operator to simultaneously control operation of both of the injection devices.

7. The railroad tie maintenance vehicle of claim 6, wherein the joystick is configured to allow the single operator to control the powered actuator assembly to move the at least two injection devices simultaneously, in tandem, and to dispense a chemical from both injection devices.

8. The railroad tie maintenance vehicle of claim 1, further comprising a crawler assembly in direct contact with a railbed and configured to support the vehicle and to transfer a motive power from an on-board motive power source to propel the vehicle.

9. The railroad tie maintenance vehicle of claim 1, further comprising a debris removal device configured to remove debris on the railroad tie obstructing the spike hole.

10. A railroad tie maintenance vehicle for sealing spike holes in a tie of a railway comprising:

a chassis including an operator work station;

a plurality of wheels that support the chassis and that are configured to engage at least one railroad track;

a motive power source that is supported on the chassis and that propels the vehicle to move along the railway;

a work head that is mounted on the chassis and that is movable longitudinally relative to the chassis;

a source of chemical solution mounted on the chassis;

at least two injection devices that are supported on the work head and that are configured to receive the chemical solution from the source and to dispense the chemical solution into the spike holes;

a powered actuator assembly that is operable to move the at least two injection devices vertically, laterally, and longitudinally relative to the chassis; and at least one controller in the operator work station and operable by a single operator within the work station to control the powered actuator assembly to move the at least two injection devices relative to the chassis and relative to each other to a location in alignment with the spike holes and to dispense the chemical solution into the spike holes.

11. The railroad tie maintenance vehicle of claim 10, further comprising at least one swing arm which is supported on the work head and which supports at least one of the injection devices, the swing arm being configured to move the injection device laterally and vertically relative to the work head and relative to the other injection device.

12. The railroad tie maintenance vehicle of claim 10, further comprising:

an automatically operated drive that moves the work head relative to the chassis based on a measured speed of the vehicle and a known distance between successive railroad ties.

13. The railroad tie maintenance vehicle of claim 12, wherein the source of chemical solution comprises first and second tanks storing respective components of the solution, and wherein the components are mixed by the injection devices prior to being dispensed therefrom.

14. A method of operating a railroad tie maintenance vehicle to seal spike holes in a railroad tie of a railway comprising the steps of:

via action of a single operator, manually operating at least one controller supported on a chassis of a vehicle travelling along a railway to a) more at least two injection devices relative to the chassis and relative to each other into alignment with respective spike holes of the railroad tie; and b) control the dispensing of a chemical solution into the spike holes.

15. The method of claim 14, wherein the operating step comprises manipulating a single controller to remotely control operation of the at least two injection devices.

16. The method of claim 15, wherein the operating step causes the at least two injection devices to move in tandem longitudinally and laterally relative to the chassis.

17. The method of claim 14, further comprising the step of:

automatically moving the at least two injection devices, relative to the chassis, to an approximate location above the spike holes based on a prevailing speed of the vehicle and a known distance between successive railroad ties.

18. The method of claim 17, wherein the step of manually operating occurs simultaneously with or after the step of automatically moving.

19. The method of claim 14, further comprising removing a debris from a surface of the railroad tie with a retractable debris removal device supported on the chassis.

20. The railroad tie maintenance vehicle of claim 12, wherein the at least one controller includes a joystick manually operable by the single operator in the work station to simultaneously control operation of both of the injection devices, and wherein the joystick is configured to allow the single operator to control the powered actuator assembly to move the at least two injection devices simultaneously, in tandem, and to dispense the chemical solution from both injection devices.

* * * * *